US011352740B2

(12) United States Patent
Ivy et al.

(10) Patent No.: US 11,352,740 B2
(45) Date of Patent: Jun. 7, 2022

(54) COMPOSITIONS FOR THE TREATMENT OF ARTICLES, AND ARTICLES TREATED THEREFROM

(71) Applicant: INV PERFORMANCE SURFACES, LLC, Wilmington, DE (US)

(72) Inventors: Michelle A. Ivy, Columbia, SC (US); Carlos Carrillo, Columbia, SC (US); Mary Glesner, Columbia, SC (US); Keegan Rhoades, Columbia, SC (US); Anand Viswanath, Columbia, SC (US)

(73) Assignee: INV Performance Surfaces, LLC, Wilmington, DE (US)

( * ) Notice: Subject to any disclaimer, the term of this patent is extended or adjusted under 35 U.S.C. 154(b) by 0 days.

(21) Appl. No.: 16/302,782

(22) PCT Filed: May 23, 2017

(86) PCT No.: PCT/US2017/034003

§ 371 (c)(1),
(2) Date: Nov. 19, 2018

(87) PCT Pub. No.: WO2017/205374

PCT Pub. Date: Nov. 30, 2017

(65) Prior Publication Data

US 2019/0218709 A1 Jul. 18, 2019

Related U.S. Application Data

(60) Provisional application No. 62/340,871, filed on May 24, 2016.

(51) Int. Cl.
*D06M 15/643* (2006.01)
*D06M 15/65* (2006.01)
(Continued)

(52) U.S. Cl.
CPC ..... *D06M 15/643* (2013.01); *D06M 11/79* (2013.01); *D06M 15/65* (2013.01);
(Continued)

(58) Field of Classification Search
CPC ... C08K 7/04; H01B 1/22; H01B 1/24; H05K 9/0088; H05K 9/009; H05K 5/0047;
(Continued)

(56) References Cited

U.S. PATENT DOCUMENTS

| | | | | |
|---|---|---|---|---|
| 2007/0028391 | A1* | 2/2007 | Dodd | C11D 3/126 8/115.51 |
| 2011/0039753 | A1* | 2/2011 | Gauvin | C11D 3/0015 510/327 |
| 2012/0077725 | A1 | 3/2012 | Wang et al. | |
| 2014/0066353 | A1* | 3/2014 | Wang | C11D 3/42 510/299 |
| 2015/0004351 | A1 | 1/2015 | Iverson et al. | |

FOREIGN PATENT DOCUMENTS

| | | | |
|---|---|---|---|
| CN | 102639673 | A | 8/2012 |
| WO | 2010102882 | A2 | 9/2010 |

(Continued)

OTHER PUBLICATIONS

International Search Report and Written Opinion dated Aug. 28, 2017, for International Application No. PCT/US2017/034003, 11 pages.

(Continued)

*Primary Examiner* — Camie S Thompson

(57) ABSTRACT

A composition for the treatment of fiber, yarn and fabrics, said composition comprising at least one highly dispersible clay nanoparticle component, at least one silicone polymer component; and water. Also provided is fiber surface treated with these compositions as well as articles including yarns, fabrics and carpets of the surface treated fiber.

36 Claims, 5 Drawing Sheets

(51) Int. Cl.
*D06M 23/08* (2006.01)
*D06M 11/79* (2006.01)
*D06M 101/34* (2006.01)

(52) U.S. Cl.
CPC ..... *D06M 23/08* (2013.01); *D06M 2101/34* (2013.01); *D06M 2200/01* (2013.01)

(58) Field of Classification Search
CPC ..... H05K 9/0083; Y10T 428/24994; Y10T 428/25; G01S 13/931; G01S 2007/027; G01S 7/4813; H01Q 1/526; H01Q 17/002; H01Q 1/256; D10B 2503/04; D10B 2331/02; D10B 2331/04; C11D 3/373; C11D 3/001; D06M 15/65; D06M 15/643
USPC ..... 428/297.4, 323, 462, 327, 87, 96; 252/500, 62.54, 8.62; 419/24, 10; 526/348.7; 8/115.6, 115.7, 116.1, DIG. 1; 510/507, 466, 535, 515, 528; 427/427; 442/93; 525/431, 446; 977/961
See application file for complete search history.

(56) References Cited

FOREIGN PATENT DOCUMENTS

| | | | |
|---|---|---|---|
| WO | 2015073814 | A1 | 5/2015 |
| WO | 2015157419 | A1 | 10/2015 |
| WO | 2017205374 | A1 | 11/2017 |

OTHER PUBLICATIONS

Chen Jingzhong et al. "Modern Crystal Chemistry Theory and Method", Aug. 31, 2000, pp. 415-416.
Luo Jutao et al., "Textile Organic Silicon and Organic Fluorine Treatment", Jan. 31, 1990, pp. 47-48.
Office Action received for CN Application No. 201780037867.6, dated Dec. 30, 2020, 22 Pages (13 Pages of English Translation and 09 Pages of Official notification).
Wu Senji, "Organic Silicon and Its Application", May 31, 1990, pp. 81-83.

* cited by examiner

COMPOSITIONS FOR THE TREATMENT OF ARTICLES, AND ARTICLES TREATED THEREFROM

FIELD OF INVENTION

The present disclosure relates to compositions for anti-soil treatment of articles. These compositions are water repellent and fluorine-free. Also provided are methods for their production. The present disclosure also relates to fiber surfaces treated with this composition, as well as articles such as yarns, fabrics and carpets comprising the surface treated fiber.

BACKGROUND

Fluorine containing chemicals are often used as fiber treatments to impart soil resistance and water repellency to the textile.

U.S. Pat. No. 9,194,078 discloses a soil repellency aqueous dispersion comprising a clay nanoparticle component and fluorochemicals for treatment of various fibers, yarns and textiles.

Due to regulations on the use of fluorochemicals as well as cost, fluorine-free treatments are being sought as replacements for these fluorine-based fiber treatments. The desire is to develop fluorine-free replacements without compromising the anti-soil, water repellency, and softness properties of the treatment.

PCT/US2014/065691 discloses the use of high levels of a clay nanoparticle as a fluorine-free fiber treatment to impart anti-soil properties. When greater than 2000 ppm of nanoparticles are applied to the carpet, excellent anti-soil properties are observed; however, the treatment does not provide any water repellency to the textile.

PCT/US2015/024926 discloses various water repellent, fluorine-free, anti-soil fiber treatments that combine a nanoparticulate silicate clay, a self-crosslinking acrylic copolymer, water and/or a textile softening agent, in various combinations.

Published U.S. Patent Application 2015/0004351 discloses a composition in aqueous dispersion for application on fibers inclusive of a liquid repellent composition comprising a wax and a soil repellant composition comprising at least one clay particle.

SUMMARY OF THE INVENTION

An aspect of the present invention relates to a composition for surface treatment of fiber. The composition comprises at least one highly dispersible clay nanoparticle component and at least one silicone polymer component. This composition is useful as a water repellent, fluorine-free, anti-soil fiber treatment.

In one nonlimiting embodiment, the at least one highly dispersible clay nanoparticle component comprises clay nanoparticles such as montmorillonite, hectorite, saponite, nontronite, beidellite and combinations thereof.

In one nonlimiting embodiment, the clay nanoparticle is synthetic.

In one nonlimiting embodiment, the clay nanoparticle is synthetic hectorite.

In one nonlimiting embodiment, the clay nanoparticles have at least one substantially flat surface.

In one nonlimiting embodiment, the clay nanoparticles are substantially disc-like in shape.

In one nonlimiting embodiment, the clay nanoparticles have a diameter in the range of about 10 to about 30 nm and/or a height in the range of 0.1 to about 10 nm.

In one nonlimiting embodiment, the composition is applied to fiber formed from polymers such as polyamides, polyesters, or polyolefins or a blend or combination thereof.

In one nonlimiting embodiment, the polymer is a polyamide such as nylon 6, nylon 6,6 or a blend or combination thereof.

In one nonlimiting embodiment, the silicone polymer component of the composition comprises a functional silicone polymer, wherein the functional silicone polymer comprises at least one functional moiety. In one nonlimiting embodiment, the functional moiety is epoxy-modified.

In one nonlimiting embodiment, the composition further comprises water and/or at least one surfactant.

In one nonlimiting embodiment, the at least one highly dispersible clay nanoparticle component is present in a range from about 5 percent to about 50 percent by weight and/or the at least one silicone polymer component is present in a range from about 0.5 to about 10 percent by weight and/or the water is present in a range from about 40 to about 95 percent by weight.

Another aspect of the present invention relates to an article treated with this composition.

Another aspect of the present invention relates to fiber surface treated with this composition.

In one nonlimiting embodiment, the at least one highly dispersible clay nanoparticle component of the composition is present in a range from about 0.01 percent to about 5 percent on weight of fiber (OWF) and the at least silicone polymer component is present in a range from about 0.001 to about 0.5 percent OWF.

Another aspect of the present invention relates to a yarn formed from fiber surface-treated with this composition.

Another aspect of the present invention relates to a fabric formed from yarn of fiber surface-treated with this composition.

Another aspect of the present invention relates to carpet formed from yarn of fiber surface-treated with this composition.

DETAILED DESCRIPTION OF THE INVENTION

Figure 1:
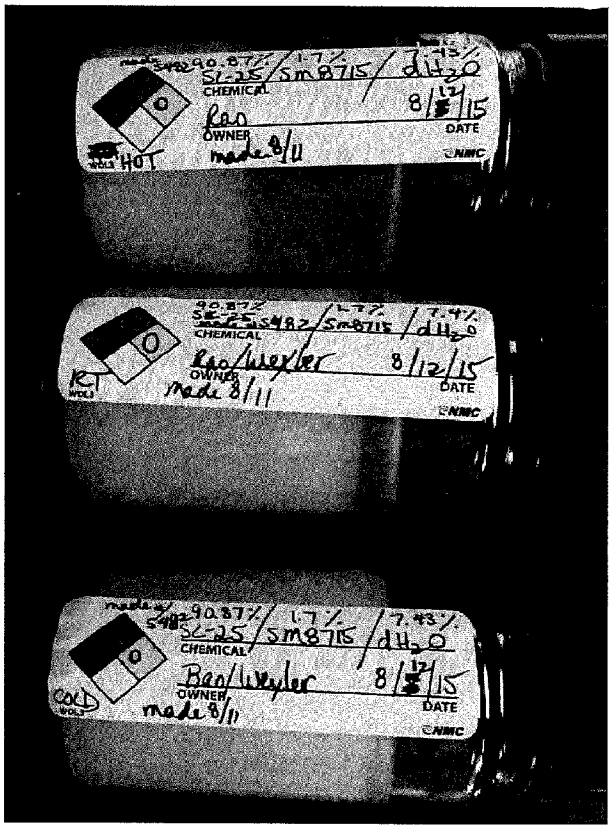
FIG. 1 is a photograph of jars of concentrated composition with the combination of 22.7 wt. % Laponite®-S 482, 1.7% epoxy functional silicone component (DOW CORNING® SM 8715 EX), and 75.6 wt. % water. After S482 was charged to the jar, the solution was allowed to cure for 2 hours, with no stirring. The solution was then stirred 30 minutes, portioned into three glass jars, and each stirred an additional 1.5 hours. The jar contents were then subjected to hot (55° C.; left jar), room temp (22° C.; center jar), and cold (2° C.; right jar) temperature for 24 hours, then returned to room temperature. Separation was observed at all temperatures.

This disclosure relates to compositions which provide a water-repellent, fluorine-free, anti-soil fiber treatment and articles treated with these compositions. The performance of this topical chemistry on carpet, including loop pile and cut pile carpets, exceeds the current fluorine-based topical treatments. Further, the treatment may comprise only two active ingredients, which is an improvement to current three-chemical fluorine-free treatments.

The compositions of the present invention comprise at least one highly dispersible clay nanoparticle component. Without being limited to any specific mechanism of action, it is believed that the clay nanoparticles impart anti-soil properties. Further, the anti-soil properties achieved through the clay nanoparticles are not affected by additional components included in the compositions of the present invention.

By "highly dispersible" as used herein, it is meant a clay nanoparticle dispersible in deionized water at least 0.1 wt % solids, more preferably at least 0.5 wt % solids, or more preferably at least 1.0 wt % solids with or without sonication. Examples of highly dispersible clay nanoparticle components useful in the present invention include, but are not limited to, clay nanoparticles comprising montmorillonite, hectorite, saponite, nontronite or beidellite or combinations thereof. In one nonlimiting embodiment, the highly dispersible clay nanoparticle component is synthetic. In one nonlimiting embodiment, the highly dispersible clay nanoparticle component is synthetic hectorite. An example of a clay particle not highly dispersible and therefore not included within the present invention is kaolin.

In one nonlimiting embodiment, at least one highly dispersible clay nanoparticle component of the composition comprises clay nanoparticles with at least one substantially flat surface. In one nonlimiting embodiment, at least one highly dispersible clay nanoparticle component of the composition comprises clay nanoparticles with a substantially disc like shape. In these nonlimiting embodiments, the clay nanoparticles may have a diameter in the range of about 10 to about 1000 nm. In another nonlimiting embodiment, the clay nanoparticles may have a diameter in the range of about 20 to about 30 nm. In these nonlimiting embodiments, the clay nanoparticles may have a height in the range of about 0.1 to about 10 nm. In another nonlimiting embodiment, the clay nanoparticles may have a height in the range of about 0.5 to about 1.5 nm.

The compositions of the present invention further comprise at least one silicone polymer component. Without being limited to any specific mechanism of action, it is believed that the water repellency is achieved through the use of the silicone polymer component. Further, exceptional water repellency is observed with very low amounts of the silicone component. The silicone polymers disclosed in the present disclosure also provide a level of softness or hand that makes the treated fibers, yarns and fabrics treated useful for industrial and consumer use. For example, carpets made from fibers treated with the compositions of the present disclosure have a softness level or hand that allows them to meet and exceed current industry standards. Suitable silicone polymers include, but are not limited to amino-functionalized silicones or polydimethylsiloxane. In one nonlimiting example, the at least one silicone polymer component comprises a functional silicone polymer, wherein the functional silicone polymer comprises at least one functional moiety. In another nonlimiting embodiment, the functional moiety is present in an amount equal to or greater than about 1 weight percent of the functional silicone copolymer. In another nonlimiting embodiment, the functional moiety is present in an amount in the range of about 1 to about 10 weight percent of the functional silicone copolymer. In another nonlimiting embodiment, the functional moiety is epoxy-modified. As used herein, the term epoxy functional silicone is used interchangeably with a functional silicone polymer wherein the functional moiety is epoxy-modified. A nonlimiting example of a silicone polymer is a macroemulsion of alkyl modified aminosiloxane referred to as TUBINGAL OHS by CHT BEZEMA. Additional nonlimiting examples of silicone polymers and functional silicone polymers include Apexosil DH-019B by Apexical, POLON-MF-14 and POLON-MF-56 by Shin-Etsu Chemical Co., and Powersoft CF 20 by Wacker Chemie AG. Nonlimiting examples of functional silicone polymers, wherein the functional moiety is an epoxy group are SM 8701 EX, SM 8715 EX, BY 22-893, and BY 22-818 EX, sold commercially by DOW CORNING®, POLON-MF-18T and X-51-1264 by Shin-Etsu Chemical Co., and SIPELL® RE 63 F by Wacker Chemie AG.

In one nonlimiting embodiment, the compositions of the present invention further comprise a surfactant. The surfactant may be ionic or nonionic. In one nonlimiting embodiment, the surfactant is nonionic. In another nonlimiting embodiment, the surfactant is a linear nonionic surfactant. In another nonlimiting embodiment, the surfactant has a hydrophile-lipophile balance (HLB) number of about 9. In yet another nonlimiting embodiment, the surfactant is a linear, nonionic surfactant with an HLB number of about 9. In another embodiment, the surfactant is a linear lauryl ether with an HLB value of about 9. A nonlimiting example of a linear lauryl ether is ETHAL LA-4, sold commercially by Ethox Chemicals.

Unlike previously disclosed chemistries for similar surface treatments, compositions of the present invention are durable on fiber, yarn, and the like, without the addition of a self-crosslinking acrylic copolymer, even following hot water extraction.

In one nonlimiting embodiment, the compositions of the present invention comprise at least one highly dispersible clay nanoparticle component present in a range from about 5 percent to about 50 percent by weight of total composition.

In one nonlimiting embodiment, the compositions of the present invention comprise at least one silicone polymer component present in a range from about 0.5 to about 10 percent by weight of total composition.

In one nonlimiting embodiment, the compositions of the present invention comprise water present in a range from about 40 to about 95 percent by weight of total composition.

In one nonlimiting embodiment, the compositions of the present invention further comprise at least one surfactant present in a range from about 0.1 percent to about 5 percent by weight of total composition.

In one nonlimiting embodiment, the compositions of the present invention may further comprise a biocide, to extend the shelf-life of the concentrate. It has been found herein that addition of up to 0.3% of a biocide such as Acticide LA or Acticide MBS can be added to the composition, without impacting performance of the treatment on fiber.

As shown herein, compositions of the present invention are stable at room temperature, cold (2° C.), and hot (55° C.) temperatures. The compositions can also withstand cycling between hot (55° C.), cold (2° C.), and room temperature conditions.

The compositions of the current invention may also be applied or co-applied on a fiber, yarn or fabric with known treatments. These known treatments include stain blockers, softeners and pH modifiers.

Concentrates of the compositions of the present invention can be diluted and applied to fiber to impart soil and water repellency.

Thus, another respect of the current invention relates to fiber comprising a surface treatment, wherein the surface treatment comprises at least one highly dispersible clay nanoparticle component; and at least one silicone polymer component.

In one nonlimiting embodiment, fiber, surface-treated in accordance with the present disclosure, is formed from a polymer selected from the group consisting of polyamides, polyesters and polyolefins, and combinations thereof.

By "combinations thereof" as used herein it is meant to include polymer combinations, blends and copolymers thereof, as well as bicomponent fibers in, for example, a core-sheath or side-by-side configuration.

In one nonlimiting embodiment, fiber comprises a polyamide such as, but not limited to, nylon 6 and nylon 6,6 and combinations thereof.

The surface treatment applied to the fiber comprises at least one highly dispersible clay nanoparticle component.

Examples of highly dispersible clay nanoparticle components useful in the present invention include, but are not limited to, clay nanoparticles comprising montmorillonite, hectorite, saponite, nontronite or beidellite or combinations thereof. In one nonlimiting embodiment, the highly dispersible clay nanoparticle component is synthetic. In one nonlimiting embodiment, the highly dispersible clay nanoparticle component is synthetic hectorite.

In one nonlimiting embodiment, at least one highly dispersible clay nanoparticle component of the surface treatment comprises clay nanoparticles with at least one substantially flat surface. In one nonlimiting embodiment, at least one highly dispersible clay nanoparticle component of the surface treatment comprises clay nanoparticles with a substantially disc like shape. In one nonlimiting embodiment, at least one highly dispersible clay nanoparticle component of the composition comprises clay nanoparticles with a substantially disc like shape. In these nonlimiting embodiments, the clay nanoparticles may have a diameter in the range of about 10 to about 1000 nm. In another nonlimiting embodiment, the clay nanoparticles may have a diameter in the range of about 20 to about 30 nm. In these nonlimiting embodiments, the clay nanoparticles may have a height in the range of about 0.1 to about 10 nm. In another nonlimiting embodiment, the clay nanoparticles may have a height in the range of about 0.5 to about 1.5 nm.

The surface treatment applied to the fiber further comprises at least one silicone polymer component.

In one nonlimiting embodiment, the silicone polymer component used in the surface treatment comprises at least one silicone polymer component. Without being limited to any specific mechanism of action, it is believed that the water repellency is achieved through the use of the silicone polymer component. Further, exceptional water repellency is observed with very low amounts of the silicone component. The silicone polymers disclosed in the present disclosure also provide a level of softness or hand that makes the treated fibers, yarns and fabrics treated useful for industrial and consumer use. For example, carpets made from fibers treated with the compositions of the present disclosure have a softness level or hand that allows them to meet and exceed current industry standards. Suitable silicone polymers include, but are not limited to amino-functionalized silicones or polydimethylsiloxane. In one nonlimiting example, the at least one silicone polymer component comprises a functional silicone polymer, wherein the functional silicone polymer comprises at least one functional moiety. In another nonlimiting embodiment, the functional moiety is present in an amount equal to or greater than about 1 weight percent of the functional silicone copolymer. In another nonlimiting embodiment, the functional moiety is present in an amount in the range of about 1 to about 10 weight percent of the functional silicone copolymer. In another nonlimiting embodiment, the functional moiety is an epoxy group. A nonlimiting example of a silicone polymer is a macroemulsion of alkyl modified aminosiloxane, referred to as TUBINGAL OHS by CHT BEZEMA. Additional nonlimiting examples of silicone polymers and functional silicone polymers include Apexosil DH-019B by Apexical, POLON-MF-14 and POLON-MF-56 by Shin-Etsu Chemical Co., and Powersoft CF 20 by Wacker Chemie AG. Nonlimiting examples of functional silicone polymers, wherein the functional moiety is epoxy-modified are SM 8701 EX, SM 8715 EX, BY 22-893, and BY 22-818 EX, sold commercially by DOW CORNING®, POLON-MF-18T and X-51-1264 by Shin-Etsu Chemical Co., and SIPELL® RE 63 F by Wacker Chemie AG.

In one nonlimiting embodiment, the surface treated fiber further comprises a surfactant. The surfactant may be ionic or anionic. In one nonlimiting embodiment, the surfactant is nonionic. In another nonlimiting embodiment, the surfactant is a linear nonionic surfactant. In another nonlimiting embodiment, the surfactant has a hydrophile-lipophile balance (HLB) number of about 9. In yet another nonlimiting embodiment, the surfactant is a linear, nonionic surfactant with an HLB number of about 9. In another embodiment, the surfactant is a linear lauryl ether with an HLB value of about 9. A nonlimiting example of a linear lauryl ether is ETHAL LA-4, sold commercially by Ethox Chemicals.

In one nonlimiting embodiment of the surface treated fiber, the at least one highly dispersible clay nanoparticle component is present in a range from about 0.01 percent to about 5 percent on weight of fiber (OWF) and the at least one silicone component is present in a range from about 0.001 to about 0.5 percent OWF.

In one nonlimiting embodiment, the surface treated fiber further comprises at least one surfactant. In one nonlimiting embodiment, the surfactant is nonionic. In one nonlimiting embodiment of the surface treated fiber, the at least one surfactant is present in a range from about 0.001 percent to about 0.1 percent OWF.

The surface treated fiber of the present invention is useful in production of articles including, but in no way limited to, yarn, fabric and carpet.

Accordingly, the present invention also relates to yarns formed from the compositions and surface treated fiber of the present invention and fabric and carpet formed from these yarns.

The following section provides further illustration of the compositions of the present invention. These working examples are illustrative only and are not intended to limit the scope of the invention in any way.

EXAMPLES

Example 1: Materials

The following materials were used as received: Laponite®-S 482, Byk Additives & Instruments (Austin, Tex. USA); DOW CORNING® SM 8715 EX Emulsion, Dow Corning (Auburn, Mich. USA), DOW CORNING® SM 8701 EX Emulsion, Dow Corning (Auburn, Mich. USA), DOW CORNING® BY 22-818 EX Emulsion, Dow Corning Toray Co., Ltd. (Tokyo, Japan).

The following surfactant products were used: ETHAL LA-4, Ethox Chemicals, LLC; Brij® 30, Sigma-Aldrich; Brij L4-(TII), Croda; Brij® 30, Acros Organics. All of the listed surfactants were used as received.

Example 2: Soil Repellency

The procedure for drum soiling was adapted from ASTM D6540 and D1776. According to ASTM D6540, soiling tests can be conducted on up to six carpet samples simultaneously using a drum. The base color of the sample (using the L, a, b color space) was measured using the hand held color measurement instrument sold by Minolta Corporation as "Chromameter" model CR-310. This measurement was the control value. The carpet sample was mounted on a thin plastic sheet and placed in the drum. Two hundred fifty grams (250 g) of dirty Zytel 101 nylon beads (by DuPont Canada, Mississauga, Ontario) were placed on the sample. The dirty beads were prepared by mixing ten grams (10 g) of AATCC™-122 synthetic carpet soil (by Manufacturer Textile Innovators Corp. Windsor, N.C.) with one thousand grams (1000 g) of new Zytel nylon 101 beads. One thousand grams (1000 g) of steel ball bearings were added into the drum. The drum was run for 30 minutes with direction reversal after fifteen minutes and then the samples were removed. Each sample was vacuumed thoroughly and the change in fiber color from soiling was measured as $\Delta E$ using the CR-310 instrument. Samples with a high value of $\Delta E$ perform worse than samples with low $\Delta E$ value. In some cases, a % vs. control value is reported which is determined by dividing the $\Delta E$ of a sample by the $\Delta E$ of the untreated control carpet, where the untreated control carpet has a % vs. control of 100%.

Example 3: Water Repellency

An adapted procedure from the AATCC 193-2007 method was used for aqueous liquid repellency (ALR) testing. A series of seven different solutions, with each constituting a 'level', are prepared. The compositions of these solutions are listed in Table 1.

TABLE 1

Solution Composition

| Solution Rating | Solution Composition |
|---|---|
| 0 | 100% deionized water |
| 1 | 98% deionized water, 2% isopropyl alcohol |
| 2 | 95% deionized water, 5% isopropyl alcohol |
| 3 | 90% deionized water, 10% isopropyl alcohol |
| 4 | 80% deionized water, 20% isopropyl alcohol |
| 5 | 70% deionized water, 30% isopropyl alcohol |
| 6 | 60% deionized water, 40% isopropyl alcohol |

Starting with the lowest rating, three drops of liquid are applied onto the carpet surface. If at least two out of the three droplets remain above the carpet surface for 10 seconds, the carpet meets the rating. The next incremental rating is then evaluated. When the carpet fails a rating, the water repellency (ALR) rating is determined from the number corresponding to the last liquid the carpet surface resisted. In some instances in this report, an "F" is reported to indicate the carpet surface failed to withstand 100% deionized water applied to the surface, for at least 10 seconds. Other instances may list a level 0 as a synonym to a value F. A result of 0 represents a carpet surface for which 100% deionized water remains above the surface for at least 10 seconds, but a solution of 98% deionized water and 2% isopropyl alcohol cannot remain above the surface for at least 10 seconds. A level of 1 would correspond to a carpet for which a solution of 98% deionized water and 2% isopropyl alcohol remains above the surface for at least 10 seconds while a solution of 95% deionized water and 5% isopropyl alcohol cannot remain above the surface for at least 10 seconds.

Example 4: Durability Test

The durability test was adapted from AATCC™-134. The samples to be tested are secured to a surface with double sided tape. A Sandia Machines commercial extractor (model no. Sandia 50-4000) was used for the hot water extraction (HWE). The hot water extractor is filled with water and allowed to reach its maximum temperature of approximately 93° C. The samples are then extracted via hot water spray followed by extraction. One test cycle entails spraying hot water three times on a sample, and performing an extraction three times on that sample. Three cycles were performed on each sample. Multiple replicates cycles can be consecutively performed. After the desired number of replicates have been completed, the samples are left to dry. Once dry, the samples are soiled according to the method described above. A significant increase in the % vs control value (ΔE sample/ΔE untreated control) indicates that the treatment is not durable to HWE.

Example 6: Stability Studies

Stability Studies were performed on compositions of the present invention as well as comparative examples. Addition of a nonionic surfactant to the combination of S482/DOW CORNING® SM 8715 EX/water enhanced the stability of the concentrated blend.

Concentrate 1: 75.6% $H_2O$, 22.7% Laponite®-S 482, and 1.7% epoxy-modified siloxane emulsion (DOW CORNING® SM 8715 EX).

A 500 g solution was prepared. The blend was prepared as follows: 8.5 g of DOW CORNING® SM 8715 EX was added to 378 g deionized $H_2O$ and stirred for 10 minutes. 113.6 g S482 was added in portions over a 1.5 hour period with stirring. After all S482 was added, the solution was allowed to cure for 2 hours with no stirring. The solution was then stirred 30 minutes, separated into glass jars, and stirred an additional 1.5 hours. The jars were subjected to the designated temperature for 24 hours, then returned to room temperature. As shown in FIG. 1, separation was observed at all temperatures.

Figure 2:
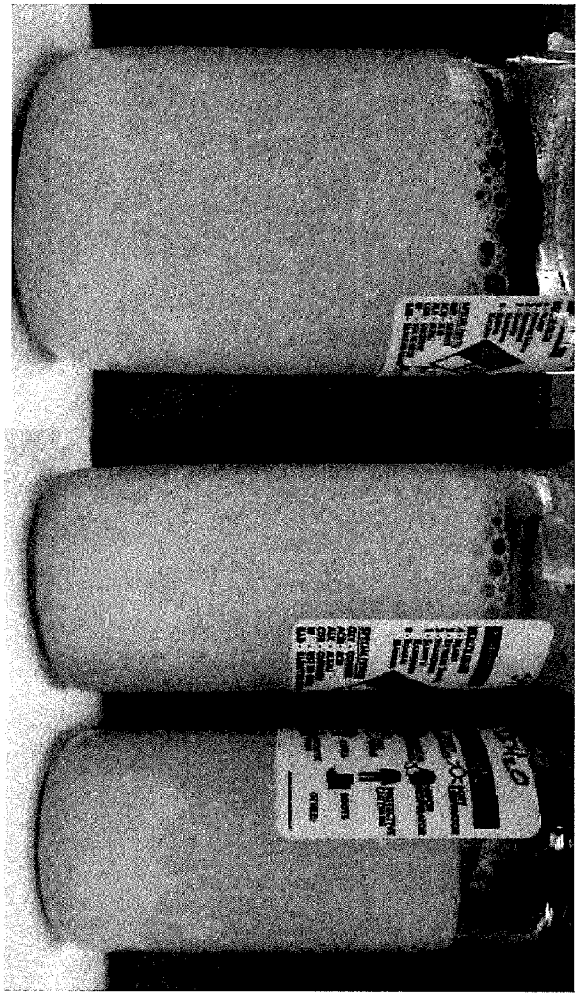
FIG. 2 is a photograph of jars of concentrated composition with the combination of 22.7 wt. % Laponite®-S 482/1.275 wt. % epoxy functional silicone component (DOW CORNING® SM 8715 EX)/75.5 wt. % water with 0.5 wt. % surfactant. The solution was allowed to stand overnight. The following morning the solution was stirred for 1 hour. The solution was portioned into three jars for temperature stability studies. The jar contents were subjected to the temperatures of room temperature (22° C.; left jar), cold (2° C.; middle jar) and hot (55° C.; right jar). No separation was seen at any temperature for approximately one month.

Concentrate A: 75.5% $H_2O$, 22.7% S482, 1.3% DOW CORNING® SM 8715 EX, 0.5% surfactant A 1 liter solution was prepared. The blend was prepared as follows: 5 g of surfactant was added to 755 g of deionized $H_2O$ and stirred for 10 minutes. 12.75 g of DOW CORNING® SM 8715 EX was added and the solution was stirred for an additional 10 minutes. 227 g of S482 was added in a quick but controlled manner with vigorous stirring. The solution was allowed to stand overnight. The following morning the solution was stirred for 1 hour. The solution was separated into three jars for temperature stability studies. As shown in FIG. 2, no separation was seen at any temperature for approximately one month.

Figure 3:
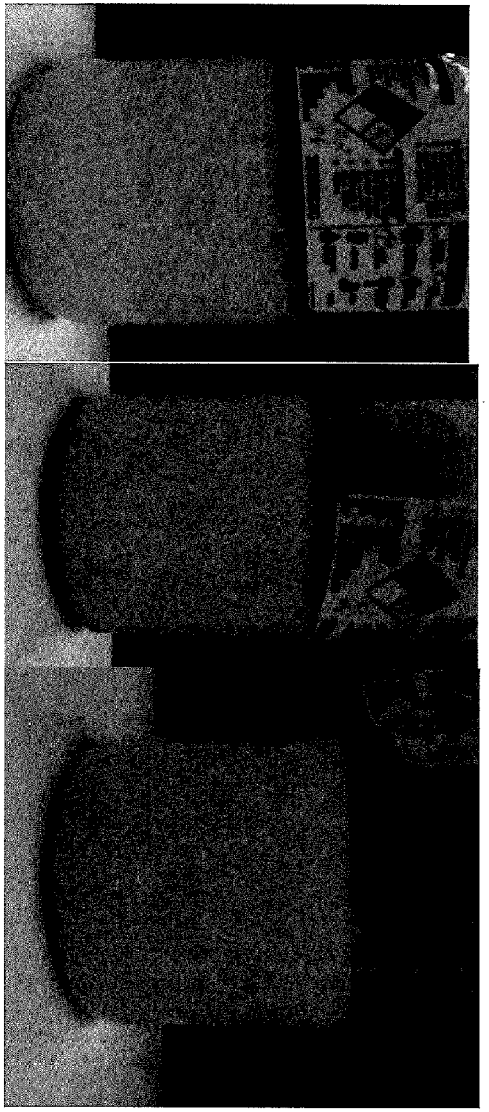
FIG. 3 is a photograph of jars of concentrated composition with the combination of 22.7% Laponite® S 482/1.7% epoxy functional silicone component (Dow Corning® SM 8715 EX)/75.1% water with 0.5% surfactant. The solution was allowed to stand overnight. The following morning the solution was stirred for 1 hour. The solution was separated into three jars for temperature stability studies. The jars were subjected to the temperatures of room temperature (22° C.; left jar), cold (2° C.; middle jar) and hot (55° C.; right jar). No separation was seen at any temperature for several weeks. The sample that had been subjected to cold was brought to room temperature. The sample that had been subjected to hot temperature was cycled between hot and cold temperatures by placing it in cold (2° C.) for 24 hours then back to hot (55° C.) for 24 hours. The sample was cycled 10 times then brought to room temperature. No separation was observed following temperature cycling.

Concentrate B: 75.1% $H_2O$, 22.7% S482, 1.7% DOW CORNING® SM 8715 EX, 0.5% surfactant A 1 liter solution was prepared. The blend was prepared as follows: 5 g of surfactant was added to 751 g of deionized $H_2O$ and stirred for 10 minutes. 17 g of DOW CORNING® SM 8715 EX was added and the solution was stirred for an additional 10 minutes. 227 g of S482 was added in a quick but controlled manner with vigorous stirring. The solution was allowed to stand overnight. The following morning the solution was stirred for 1 hour. The solution was separated into three jars for temperature stability studies. No separation was seen at any temperature for several weeks. The sample that had been subjected to cold was brought to room temperature. The sample that had been subjected to hot temperature was cycled between hot and cold temperatures by placing it in cold (2° C.) for 24 h then back to hot (55° C.) for 24 h. The sample was cycled 10 times then brought to room temperature. As shown in FIG. 3, no separation was observed following temperature cycling.

Figure 4:
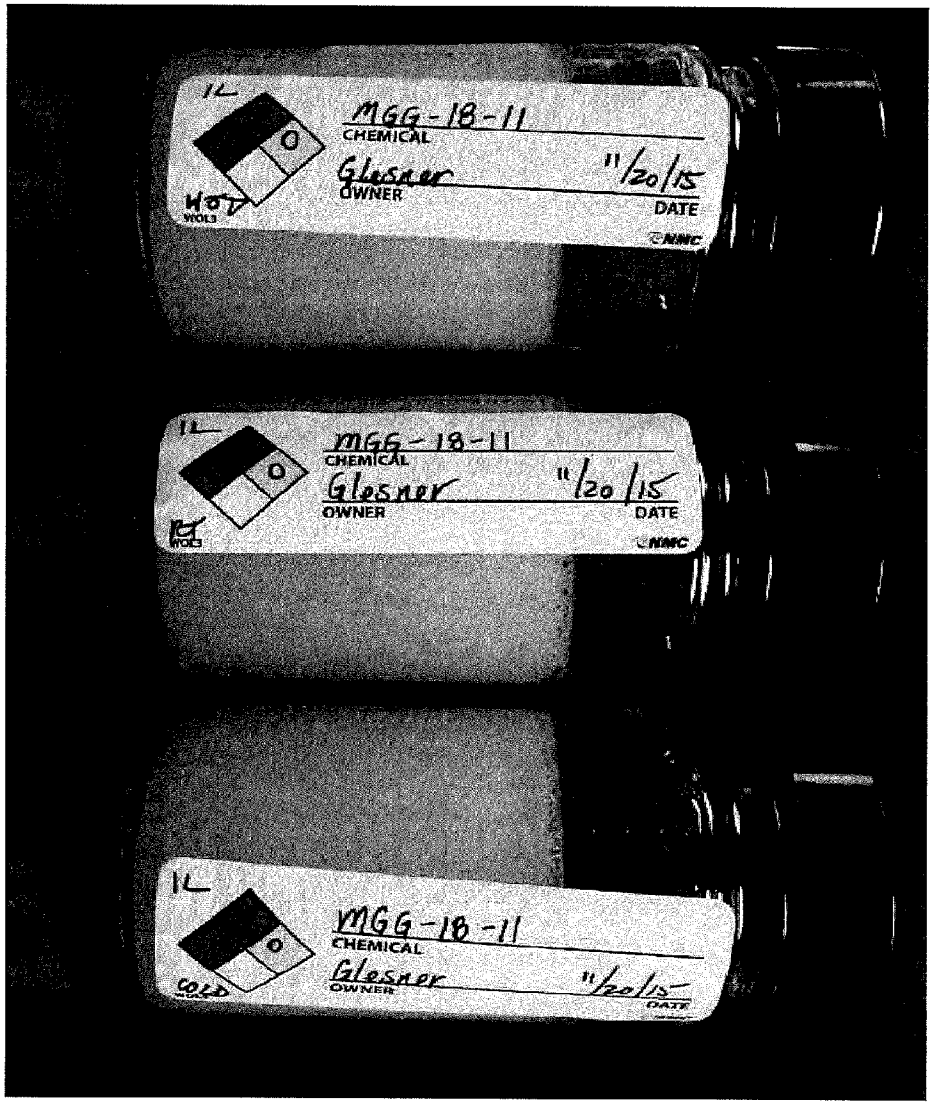
FIG. 4 is a photograph of jars of concentrated composition with the combination of 22.7% Laponite®-S 482/1.7% epoxy functional silicone component (DOW CORNING® SM 8715 EX)/75.1% water with 0.5% surfactant. The concentrate was allowed to stand overnight. The following morning, the solution was stirred for 1 hour. The solution was separated into three jars for temperature stability studies. The jars were subjected to the temperatures of hot (55° C.; left jar), room temp (22° C.; middle jar) and cold (2° C.; right jar) for 24 hours then moved to room temperature. No separation was seen at any temperature.

Concentrate C: 75.1% $H_2O$, 22.7% S482, 1.7% DOW CORNING® SM 8715 EX, 0.5% surfactant A 1 liter solution was prepared. The blend was prepared as follows: 5 g of surfactant was added to 751 g of deionized $H_2O$ and stirred for 10 min. 17 g of DOW CORNING® SM 8715 EX was added and the solution was stirred an additional 10 minutes. 227 g of S482 was added in portions over 1 hour with vigorous stirring. The solution was allowed to stand overnight. The following morning, the solution was stirred for 1 h. The solution was separated into three jars for temperature stability studies. Samples were exposed to the temperature for 24 h then moved to room temperature. As shown in FIG. 4, no separation was seen at any temperature.

Figure 5:
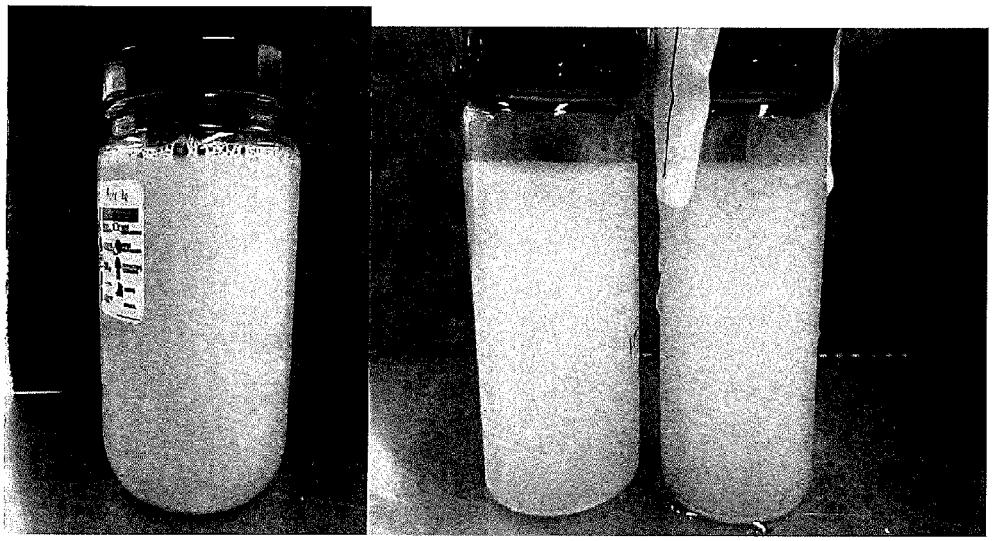
FIG. 5 is photograph of jars of concentrated composition with the combination of 22.6% Laponite®-S 482/1.7% epoxy functional silicone component (DOW CORNING® SM 8715 EX)/75.0% water with 0.5% surfactant and 0.2% biocide. The solution was allowed to stand overnight. The following morning, the solution was stirred for 1 hour. The solution was separated into three jars for temperature stability studies. The jars were subjected to the temperatures of room temperature (22° C.; top jar), hot (55° C.; bottom left jar) and cold (2° C.; bottom right jar). No separation was seen at any temperature after one week.

Concentrate D: 75.0% $H_2O$, 22.6% S482, 1.7% DOW CORNING® SM 8715 EX, 0.5% surfactant, 0.2% biocide A 1 liter solution was prepared. The blend was prepared as follows: 5 g of surfactant was added to 750 g of deionized $H_2O$ and stirred for 10 minutes. 17 g of DOW CORNING® SM 8715 EX was added and the solution was stirred an additional 10 minutes. 226 g of S482 was added in a quick but controlled manner with vigorous stirring. The solution was allowed to stand overnight. The following morning, 2 g of biocide was added and the solution was stirred for 1 h. The solution was separated into three jars for temperature stability studies. As shown in FIG. 5, no separation was seen at any temperature after one week.

Figure 6:
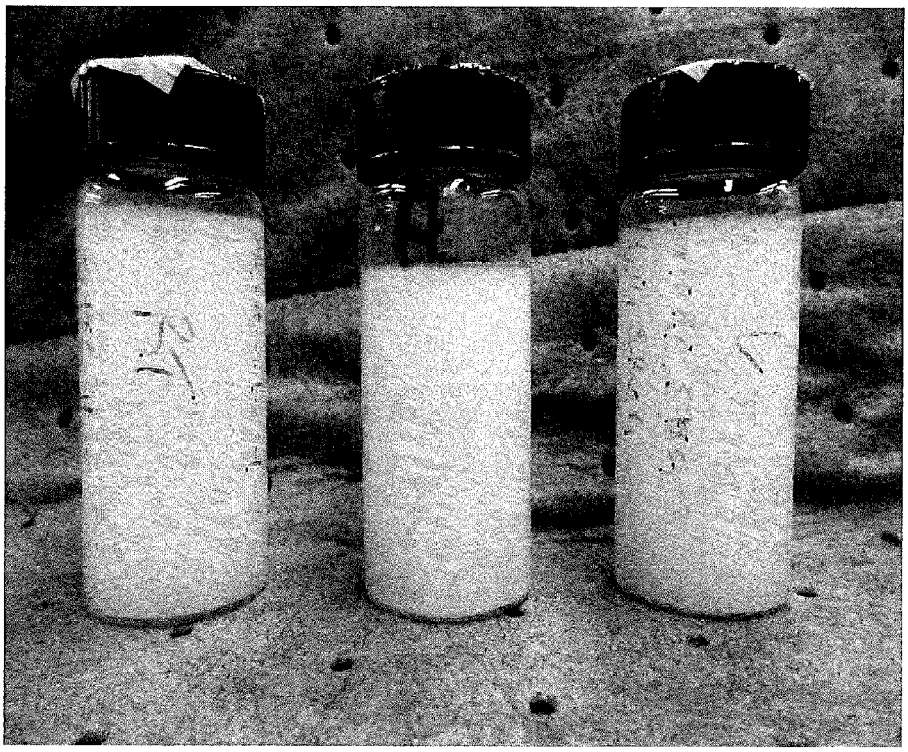
FIG. 6 is photograph of jars of concentrated composition with the combination of 22.6% Laponite®-S 482/1.7% epoxy functional silicone component (DOW CORNING® SM 8715 EX)/74.5% water with 1.0% surfactant and 0.2% biocide. The solution was allowed to stand overnight. The following morning, the solution was stirred for 1 hour. The solution was separated into three jars for temperature stability studies. The jars were subjected to the temperatures of room temperature (22° C.; left jar), hot (55° C.; middle jar) and cold (2° C.; right har) then brought to room temperature. No separation was seen in any of the samples for 16 months.

Concentrate E: 74.5% $H_2O$, 22.6% S482, 1.7% DOW CORNING® SM 8715 EX, 1.0% surfactant, 0.2% biocide A 100 mL solution was prepared. The blend was prepared as follows: 1 g of surfactant was added to 74.5 g of deionized $H_2O$ and stirred for 10 minutes. 1.7 g of DOW CORNING® SM 8715 EX was added and the solution was stirred an additional 10 minutes. 22.6 g of S482 was added in a quick but controlled manner with vigorous stirring. The solution was allowed to stand overnight. The following morning, 0.2 g of biocide was added and the solution was stirred for 1 h. The solution was separated into three jars for temperature stability studies. As shown in FIG. 6, no material separation was seen in any formulation sample, after more than one year.

Figure 7:
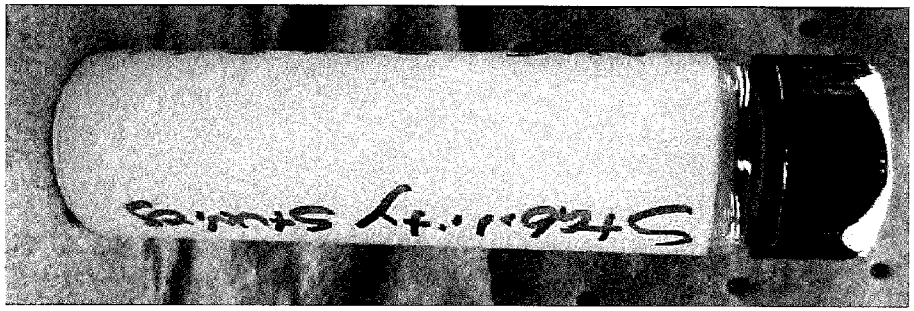
FIG. 7 is photograph of jars of concentrated composition with the combination of 22.6% Laponite®-S 482/1.7% epoxy functional silicone component (DOW CORNING® SM 8715 EX)/74.5% water with 1.0% surfactant and 0.2% biocide. The solution was allowed to stand overnight. The following morning, the solution was stirred for 1 hour. A small sample was poured into ajar for stability testing. No separation was seen after ten months at room temperature (22° C.).

Concentrate F: 74.5% $H_2O$, 22.6% S482, 1.7% DOW CORNING® SM 8715 EX, 1.0% surfactant, 0.2% biocide A 30 liter solution was prepared in two 15 liter batches. The two 15 liter blends were prepared as follows: 150 g of surfactant was added to 11175 g of deionized $H_2O$ and stirred for 10 minutes. 255 g of DOW CORNING® SM 8715 EX was added and the solution was stirred an additional 10 minutes. 3390 g of S482 was added in a quick but controlled manner with vigorous stirring. The solutions were allowed to stand overnight. The following morning, 30 g of biocide was added and the solutions were stirred for 1 hour. The two batches were combined and a small sample of the blend was poured in ajar for stability testing. As shown in FIG. 7, no material separation was seen after more than one year.

Example 7: Soiling, Water Repellency, and Durability Studies

Two types of carpet were used for testing. The first was a commercial construction, 1245 denier, nylon 6,6 loop carpet with 4.75 twists per inch, a 7/32 inch pile height, and 1/10 of an inch gauge. The weight of the carpet was 32 ounces per square yard. The carpet was dyed a light wheat beige color. The second was a residential construction, 995 denier, saxony style, cut pile nylon 6,6 carpet (9/16" pile height, 13-14 stitches per inch, 1/8" gauge). The unbacked carpet weight was 45 oz./yd2. The carpet was dyed wool beige.

TABLE 2

Drum Soiling and Water Repellency Studies, commercial construction

| Item | Description | Soiling, % vs control | ALR |
|---|---|---|---|
| 1 | Untreated control | 100 | F |
| 2 | 1.8% owf SL-25 | 56 | F |
| 3 | 0.034% owf SM-8715 EX | — | 3 |
| 4 | 0.034% owf SM-8701 EX | 106 | 3 |
| 5 | 0.034% owf BY 22-818 EX | — | 3 |
| 6 | 1.8% owf SL-25, 0.034% owf SM-8715 EX | 63 | 3 |
| 7 | 1.8% owf SL-25, 0.034% owf SM-8701 EX | 56 | 3 |
| 8 | 1.8% owf SL-25, 0.034% owf BY 22-818 EX | 65 | 3 |

Three epoxy-modified silicone emulsions (SM-8715 EX, SM 8701 EX, BY 22-818 EX) are shown to provide excellent water repellency at low application rates to commercial carpets. By combining the silicone emulsions with Laponite® S-482, excellent anti-soil performance is observed and the water repellency is maintained.

Concentrate G: 75.1% $H_2O$, 22.7% S482, 1.7% DOW CORNING® SM 8715 EX, 0.5% surfactant A concentrated blend was prepared as follows: 6 g surfactant was added to 901 g deionized $H_2O$ and stirred for 10 minutes. 20 g DOW CORNING® SM 8715 EX was added and the solution was stirred an additional 10 minutes. 272 g S482 was added in portions with vigorous stirring until the solution was too thick to stir. The solution was allowed to stand until the viscosity decreased, then the solution was stirred an additional 1 h.

The following day, commercial carpets were treated on a pilot-scale line by spray application with 15% wpu. Samples were cut from the treated carpet and drum soiling and water repellency studies were performed as described in Examples 2 and 3, respectively. Results are depicted in Table 3.

TABLE 3

Drum Soiling and Water Repellency Studies, commercial construction

| Item | Description | Soiling, % vs. control | ALR |
|---|---|---|---|
| 1 | Untreated control | 100 | F |
| 2 | 0.8% owf fluorine treatment (200 ppm F) | 71 | 3 |
| 3 | 2% owf Laponite ® SL-25 | 50 | F |
| 4 | 2% owf 1-component fluorine-free treatment: I-Protect ™ RS #700 | 60 | 3 |

TABLE 3-continued

Drum Soiling and Water Repellency Studies, commercial construction

| Item | Description | Soiling, % vs. control | ALR |
|---|---|---|---|
| 5 | 2% owf Concentrate G = 0.45% owf S482, 0.034% owf DOW CORNING(R) SM 8715 EX, 0.01% owf surfactant | 51 | 3 |

The current fluorine topical treatment for commercial carpets (Item 2) provides soil resistance and water repellency compared to an untreated carpet (Item 1). 2% owf SL-25 (Item 3) imparts excellent anti-soil properties, but does not have water repellency. A 1-component fluorine-free topical used currently (Item 4) provides both soil resistance and water repellency. The newly prepared concentrated blend (Concentrate H) was applied to fiber at 2% owf which corresponds to 0.45% owf S482, 0.034% owf DOW CORNING® SM 8715 EX, and 0.01% owf surfactant. The anti-soil effect of this topical treatment (Item 5) exceeds both the current fluorine chemistry and the fluorine-free treatment. The anti-soil performance is similar to 2% owf SL-25. 0.45% owf S482 is equivalent to 1.8% owf SL-25, which means that the addition of the DOW CORNING® SM 8715 EX and surfactant do not negatively impact the anti-soil performance of the SL-25 treatment; however, the blend provides water repellency that matches the current fluorine and non-fluorine treatments.

TABLE 4

Drum Soiling and Water Repellency Studies, residential construction

| Item | Description | ALR | Soiling, % vs. control |
|---|---|---|---|
| 1 | Untreated control | F | 100 |
| 2 | 1.5% owf fluorine treatment (187.5 ppm) | 3 | 76 |
| 3 | 4% owf inventive example (0.9% owf S482; 0.068% owf SM8715; 0.04% owf ETHAL) | 3 | 68 |

The current fluorine topical treatment for residential carpets (Item 2) provides soil resistance and water repellency compared to an untreated carpet (Item 1). The inventive example (Item 3) was applied to fiber at 4% owf which corresponds to 0.9% owf S482, 0.068% owf DOW CORNING® SM 8715 EX, and 0.04% owf surfactant. The anti-soil effect of this topical treatment exceeds the current fluorine chemistry treatment and matches the water repellency of the fluorine treatment.

Example 8: Drum Soiling Compared to Hot Water Extracted Soiling

Commercial carpet samples were sprayed with an HVLP gun at 15% wpu. Two sets of carpets were sprayed and carpets were cured by placing six samples at a time in an oven at 150° C. for 17 minutes. One set of samples was soiled according to the procedure outlined in Example 2. The second set was hot water extracted according to the outlined method in Example 4 then soiled according to the outlined method in Example 2. Results are shown in Table 5.

TABLE 5

Comparison of Drum Soiling versus Hot Water Extracted Soiling

| Item | Description | Before HWE ΔE | Before HWE Soiling, % vs. control | After 1 HWE ΔE | After 1 HWE Soiling, % vs. control |
|---|---|---|---|---|---|
| 1 | Untreated control | 9.6 | 100 | 7.2 | 100 |
| 2 | 0.8% owf fluorine treatment (200 ppm F) | 6.3 | 65 | 4.7 | 65 |
| 3 | 2% owf Laponite ® SL-25 | 4.8 | 49 | 4.3 | 60 |
| 4 | 2% owf 2-component fluorine-free treatment: 1% owf I-Protect RS #401 + 1% owf Wacker Finish CT 16E | 5.9 | 61 | 4.9 | 67 |
| 5 | 2% owf Concentrate A: 0.45% owf S482, 0.0255% owf DOW CORNING(R) SM 8715 EX, 0.01% owf surfactant | 5.3 | 55 | 4.1 | 57 |
| 6 | 2% owf Concentrate B: 0.45% owf S482, 0.034% owf DOW CORNING(R) SM 8715 EX, 0.01% owf surfactant | 5.8 | 61 | 4.6 | 64 |

The soiling performance of the fluorine-free, water repellent topical treatment of the present invention (Items 5 & 6) exceeded the performance of the current fluorine-based chemistry (Item 2). The performance was similar to a fluorine-free two-component system currently used (Item 4) which requires two separate solutions to be mixed and applied to the fiber. The performance is also similar to 2% owf SL-25 (Item 3); however, SL-25 does not impart water repellency, as previously described. The treatments are also shown to be durable to hot water extraction.

Example 9: Drum Soiling Compared to Hot Water Extracted Soiling after Curing

Commercial carpet samples were sprayed with an HVLP gun at 15% wpu. Two sets of carpets were sprayed and carpets were cured by placing six samples at a time in an oven at 150° C. for 17 min. One set of samples was soiled according to the procedure outlined in Example 2. The second set was hot water extracted according to the method outlined in Example 4 then soiled according to Example 2. ALR was also tested as described in Example 3. Results are shown in Table 6.

TABLE 6

Comparison of Drum Soling versus Hot Water Extracted Soiling after Curing

| Item | Description | Before HWE ALR | Before HWE ΔE | Before HWE Soiling, % vs. control | After 1 HWE ΔE | After 1 HWE Soiling, % vs. control |
|---|---|---|---|---|---|---|
| 1 | Untreated control | F | 11.7 | 100 | 8.8 | 100 |
| 2 | 0.8% owf fluorine treatment (200 ppm F) | 3 | 7.5 | 64 | 6.7 | 76 |
| 3 | 2% owf 1-component fluorine-free treatment: I-Protect ™ RS #700 | 3 | 7.0 | 60 | 5.6 | 64 |
| 4 | 2% owf 2-component fluorine-free treatment: 1% owf I-Protect RS #401 + 1% owf Wacker Finish CT 16E | 3 | 6.3 | 54 | 6.4 | 73 |
| 5 | 2% owf Concentrate A: 0.45% owf S482, 0.0255% owf DOW CORNING ® SM 8715 EX, 0.01% owf surfactant | 3 | 5.7 | 49 | 5.0 | 58 |
| 6 | 2% owf Concentrate B: 0.45% owf S482, 0.034% owf DOW CORNING ® SM 8715 EX, 0.01% owf surfactant | 3 | 5.6 | 48 | 5.0 | 57 |

Example 10: Drum Soiling Compared to Hot Water Extracted Soiling

Residential carpet samples were treated on a pilot-scale spray-bar line with 15% wpu and dried in an oven. Samples of the carpet were cut and set aside and the remaining carpet was cleaned via truck-mounted hot water extraction as described in Example 5. Following hot water extraction, samples were cut and soiled via the method in Example 2. ALR was also tested as described in Example 3. Results are shown in Table 7.

TABLE 7

Comparison of Drum Soling versus Hot Water Extracted

| Item | Description | Before HWE ALR | Before HWE ΔE | Before HWE Soiling, % vs. control |
|---|---|---|---|---|
| 1a | Untreated control | F | 24.7 | 100% |
| 2a | 1.5% owf fluorine treatment (187.5 ppm F) | 3 | 14.9 | 60% |
| 3a | Fluorine treatment with 1 HWE | 3 | 15.9 | 64% |
| 4a | Fluorine treatment with 3 HWE | 2 | 16.3 | 66% |
| 5a | Fluorine treatment with 5 HWE | 2 | 15.8 | 64% |
| 1b | Untreated control | F | 25.0 | 100% |
| 2b | 4% owf inventive example: 0.9% owf S482, 0.068% owf DOW CORNING ® SM 8715 EX, 0.04% owf surfactant | 3 | 13.3 | 53% |
| 3b | Inventive treatment with 1 HWE | 3 | 14.3 | 57% |
| 4b | Inventive treatment with 3 HWE | 2 | 14.7 | 59% |
| 5b | Inventive treatment with 5 HWE | 2 | 14.0 | 56% |

The soiling performance of the fluorine-free, water-repellent topical treatment of the present invention (Items 5 & 6) exceeded the performance of the current fluorine-based chemistry (Item 2) as well both the 1-component (Item 3) and 2-component fluorine-free (Item 4) treatments currently used. The treatments are also shown to be durable to hot water extraction. Water repellency matches the performance of the fluorine-based and fluorine-free treatments.

Example 11: Highly Dispersible Clay Nanoparticles

Experiments were performed demonstrating better efficacy of use of highly dispersible clay nanoparticles in accordance with the present invention as compared other families of clay nanoparticles which were not capable of being highly dispersed in an aqueous solution. Testing revealed that free-flowing kaolin, obtained from Sigma Aldrich, was not dispersible in deionized water at 0.1, 0.5, or 1.0 wt % solids. This outcome was determined at ambient temperature (approx. 22° C.), and at elevated temperature (55° C.). Ultrasonication also failed to improve the dispersibility of kaolin in deionized water. Even with 10 minutes of heating and stirring, there was no change in this result. This was a clear indication that kaolin was not capable of being highly dispersed in water, and then combined with an emulsified siloxane component in accordance with the present invention.

Example 12: Hand Panel

The carpet used for testing was 995 denier, saxony style, cut pile nylon 6,6 carpet (9/16" pile height, 13-14 stitches per inch, 1/8" gauge). The unbacked carpet weight was 45 oz./yd2. The carpet was dyed wool beige. A series of unlabeled carpets were placed on a table in a random order. Participants were asked to rank the carpets from softest to harshest. Once the carpets were ranked, the participant then left the room. The carpets were given a score based on the ranking where the softest carpet was given the lowest score (1) and the harshest carpet was given the highest score (varies depending on number of samples). The carpets were then placed back in the original random order and the next participant was asked to enter the room and perform the same ranking. The process was repeated for a set number of participants. The scores of all participants were averaged to give each carpet a softness rating. Lower numbers correspond to softer carpets and higher numbers correspond to harsher carpets. The results of the hand panel testing are summarized in the tables below.

TABLE 8

Hand Panel #1

| Samples | Average Ranking | Std. Deviation |
|---|---|---|
| A - 1.5% owf fluorine and Laponite ® SL-25 | 4.00 | 1.69 |
| B - 0.5% owf Laponite ® S482 | 7.63 | 3.16 |
| M - 4% owf inventive example (0.9% owf S482; 0.068% owf SM8715; 0.04% owf ETHAL) | 4.63 | 1.85 |
| N - 1% owf Laponite ® S482 + 0.15% owf SM8715 | 4.50 | 3.55 |
| O - Untreated | 1.13 | 0.35 |

8 participants total; rankings 1-15

The addition of SM-8715 EX to high levels of Laponite® S482 (items M and N) results in a significant softness benefit compared to carpets treated with Laponite® S482 alone (item B).

TABLE 9

Hand panel #2:

| Samples | Average Ranking | Std. Deviation |
|---|---|---|
| A - untreated | 2.10 | 0.99 |
| B - 1.5% owf fluorine and Laponite ® SL-25 | 2.30 | 2.21 |
| C - 0.5% owf Laponite ® S482 | 6.70 | 2.00 |
| D - 1% owf Laponite ® S482 | 8.60 | 2.41 |

TABLE 9-continued

Hand panel #2:

| Samples | Average Ranking | Std. Deviation |
|---|---|---|
| E - 2% owf inventive example (0.45% owf S482; 0.034% owf SM8715; 0.02% owf ETHAL) | 5.50 | 2.59 |
| F - 4% owf inventive example (0.9% owf S482; 0.068% owf SM8715; 0.04% owf ETHAL) | 5.80 | 2.15 |

10 participants total; rankings 1-10

The nonlimiting examples of the current disclosure which combine DOW CORNING® SM 8715 EX and Laponite® S482 (items E and F) results in a significant softness benefit compared to carpets treated with Laponite® S482 alone (Items C and D).

TABLE 10

Hand panel #3

| Samples | Average Ranking | Std. Deviation |
|---|---|---|
| G14 - untreated | 1.40 | 0.52 |
| G15 - untreated | 2.10 | 0.88 |
| H14 - 1.5% owf fluorine and Laponite ® SL-25 | 4.00 | 0.00 |
| I14 - 3% owf inventive example (0.68% owf S482; 0.051% owf SM-8715; 0.03% owf ETHAL) | 2.50 | 0.71 |

10 participants total; rankings 1-4

The nonlimiting examples of the current disclosure (I14) were ranked softer than current fluorochemical treatment (H14) by all ten hand panel participants. Softness was similar to untreated carpet, suggesting that the fluorine-free treatment does not significantly impact the hand of the carpet.

What is claimed is:

1. A fiber comprising a surface treatment, wherein the surface treatment comprises:

a) at least one highly dispersible clay nanoparticle component, wherein the at least one highly dispersible clay nanoparticle component is present in a range from about 0.01 percent to about 5 percent on weight of fiber (OWF); and b) at least one epoxy-modified silicone polymer component.

2. The fiber of claim 1 wherein the at least one highly dispersible clay nanoparticle component comprises clay nanoparticles selected from the group consisting of montmorillonite, hectorite, saponite, nontronite and beidellite and combinations thereof.

3. The fiber of claim 2 wherein the clay nanoparticle is synthetic.

4. The fiber of claim 3 wherein the clay nanoparticle is synthetic hectorite.

5. The fiber of claim 1 wherein the at least one highly dispersible clay nanoparticle component comprises clay nanoparticles with at least one substantially flat surface.

6. The fiber of claim 5 wherein the clay nanoparticles have a diameter in the range of about 10 to about 1000 nm.

7. The fiber of claim 5 wherein the clay nanoparticles have a height in the range of about 0.1 nm to about 10 nm.

8. The fiber of claim 1 wherein the at least one highly dispersible clay nanoparticle component comprises clay nanoparticles with a substantially disc shape.

9. The fiber of claim 1 wherein the fiber is formed from a polymer selected from the group consisting of polyamides, polyesters and polyolefins and combinations thereof.

10. The fiber of claim 9 wherein the polyamide is selected from nylon 6 and nylon 6,6 and combinations thereof.

11. The fiber of claim 1 wherein the epoxy of the epoxy-modified silicone polymer is present in an amount equal to or greater than about 1 weight percent of the epoxy-modified silicone polymer.

12. The fiber of claim 1 wherein the at least one epoxy-modified silicone polymer component is present in a range from about 0.001 to about 0.5 percent OWF.

13. The fiber of claim 1 further comprising at least one surfactant.

14. The fiber of claim 13 wherein the surfactant is nonionic.

15. The fiber of claim 13 wherein the at least one surfactant is present in a range from about 0.001 percent to about 0.1 percent OWF.

16. A yarn formed from the fiber of claim 1.

17. A fabric formed from the yarn of claim 16.

18. A carpet formed from the yarn of claim 17.

19. A soil resistant surface treatment composition for carpeting comprising:

a) a highly dispersible clay nanoparticle component; and b) an epoxy-modified polymer silicone, wherein the epoxy is a functional moiety of a functional silicone polymer of the epoxy-modified polymer silicone and the epoxy is in an amount equal to or less than about 10 weight percent of the functional silicone polymer.

20. A composition for the treatment of fiber, yarn and fabrics, said composition comprising:

a) at least one highly dispersible clay nanoparticle component;

b) at least one epoxy-modified silicone polymer component, wherein the epoxy of the epoxy-modified silicone polymer is present in a range of about 1 weight percent to about 10 weight percent of the epoxy-modified silicone polymer; and c) water.

21. The composition of claim 20 further comprising a surfactant.

22. The composition of claim 21 wherein the surfactant is nonionic.

23. The composition of claim 20 wherein the at least one highly dispersible clay nanoparticle component comprises clay nanoparticles selected from the group consisting of montmorillonite, hectorite, saponite, nontronite and beidellite and combinations thereof.

24. The composition of claim 23 wherein the clay nanoparticle is synthetic.

25. The composition of claim 24 wherein the clay nanoparticle is synthetic hectorite.

26. The composition of claim 20 wherein the at least one highly dispersible clay nanoparticle component comprises clay nanoparticles with at least one substantially flat surface.

27. The composition of claim 26 wherein the clay nanoparticles have a diameter in the range of about 10 to about 1000 nm.

28. The composition of claim 26 wherein the clay nanoparticles have a height in the range of about 0.1 nm to about 10 nm.

29. The composition of claim 20 wherein the at least one highly dispersible clay nanoparticle component comprises clay nanoparticles with a substantially disc shape.

30. The composition of claim 20 wherein the epoxy is present in an amount equal to 1 weight percent of the epoxy-modified silicone polymer.

31. The composition of claim 20 wherein the at least one highly dispersible clay nanoparticle component is present in a range from about 5 percent to about 50 percent by weight of total composition, the at least one epoxy-modified silicone polymer component is present in a range from about 0.5 to about 10 percent by weight of total composition and the water is present in a range from about 40 to about 95 percent by weight of total composition.

32. The composition of claim 20 further comprising at least one surfactant.

33. The composition of claim 32 wherein the surfactant is nonionic.

34. The composition of claim 32 wherein the at least one surfactant is present in a range from about 0.1 percent to about 5 percent by weight of total composition.

35. An article treated with the composition of claim 20.

36. The article of claim 35 selected from the group consisting of a fiber, a yarn, a fabric or a carpet.

* * * * *